US005556320A

United States Patent [19]

Baker

[11] Patent Number: 5,556,320

[45] Date of Patent: Sep. 17, 1996

[54] MOBILE VIBRATING ABRASIVE CLEANING APPARATUS

[75] Inventor: Bryan C. Baker, Houston, Tex.

[73] Assignee: Drilltec Patents & Technologies Company, Inc., Houston, Tex.

[21] Appl. No.: 178,737

[22] Filed: Jan. 7, 1994

[51] Int. Cl.[6] ..... B24B 51/00

[52] U.S. Cl. ..... 451/5; 451/326; 451/32

[58] Field of Search ..... 51/163.1, 164.1, 51/313, 422, 423, 429, 165.71, 165 R

[56] References Cited

U.S. PATENT DOCUMENTS

| | | | |
|---|---|---|---|
| 1,967,120 | 7/1934 | Good | 51/164.1 |
| 3,305,977 | 2/1967 | Kellard | 51/163.1 |
| 4,940,001 | 7/1990 | Holley | 51/164.1 |
| 5,233,796 | 8/1993 | Mazalewsia, Jr. | 51/429 |
| 5,305,554 | 4/1994 | Emken et al. | 451/113 |

*Primary Examiner*—Robert A. Rose
*Attorney, Agent, or Firm*—N. Elton Dry

[57] ABSTRACT

Disclosed is a mobile vibratory abrasive cleaning apparatus that includes a flatbed having wheels upon which are mounted the other components of the apparatus which include a cleaning tank, a vibrator for vibrating the tank, a loop system for circulating the abrasive cleaner through the tank, control panel and power generator supplying electricity for running the apparatus. The loop system for circulating abrasive cleaner through the tank includes sprayers in the tank, an abrasive cleaner surge tank, filter system and drain system. In operation, the abrasive cleaner is pumped from the cleaner surge tank to the sprayers in the cleaning tank, and after contacting the articles to be cleaned, the abrasive cleaner drains from the cleaning tank and is pumped back to the cleaner surge tank. Contaminants are removed via a filter provided in the surge tank and/or the drain system.

8 Claims, 1 Drawing Sheet

MOBILE VIBRATING ABRASIVE CLEANING APPARATUS

BACKGROUND OF THE INVENTION

1. Field of the Invention

The present invention relates to a cleaning apparatus. In another aspect, the present invention relates to a vibrating abrasive cleaning apparatus. In still another aspect, the present invention relates to a mobile vibrating abrasive cleaning apparatus.

2. Brief Description of the Related Art

In the oil and gas industry, parts and equipment will many times become soiled with dirt, debris, chemicals and other contaminants.

Such soiled parts and equipment are generally cleaned utilizing a vibratory abrasive cleaning apparatus in which the items to be cleaned are contacted with an abrasive solvent cleaner while being subjected to vibratory action. The combination of the vibratory action and the abrasive solvent cleaner serve to remove the dirt, debris, chemical and other contaminants from the soiled part or equipment.

Vibrating abrasive cleaning apparatus are well known in the art.

For example, Brandt, in U.S. Pat. Nos. 2,997,813 and 2,997,814 discloses machines for the precision finishing of parts by controlled vibration.

U.S. Pat. No. 3,353,796, issued Nov. 21, 1967, to Roberts, discloses a vibratory burnishing system with metered feed that utilizes an arrangement of spindle and quill shafts and eccentric weights as the vibratory drive.

U.S. Pat. No. 3,411,248, issued Nov. 19, 1968, to Dwyer et al. discloses the cleaning of objects in vibrating equipment by spraying water and polishing material into a vibrating container to contact the objects to be cleaned.

U.S. Pat. No. 3,429,744, issued Feb. 25, 1969, to McCormick discloses a cleaning process in which objects are first subjected to a freeze-blast followed by vibratory cleaning.

U.S. Pat. No. 3,464,163, issued Sep. 2, 1969, to Ferrara discloses a vibratory finishing machine which utilized a vibratory drum containing finishing media.

Additionally, Musschoot discloses various types of vibratory apparatus in U.S. Pat. Nos. 4,662,425, 4,709,507 and 4,926,601.

Other vibratory finishing or cleaning apparatus are disclosed in U.S. Pat. Nos. 949,709, 2,222,777, 3,173,664, 3,413,764, 3,637,190.

As the above patents show, many advances have been made in the field of vibratory devices for cleaning articles. However, increased environmental concerns have lead to the awareness of employing a device capable of cleaning an article in a combined solid and fluid mixture, wherein the residue is not discarded and will be environmentally reprocessed through the system. Additionally, during operation, the device must be a closed-loop system to avoid evaporation of environmentally harmful solvents to the atmosphere.

Conventional vibratory abrasive cleaning apparatus have failed to address environmental concerns by dumping the waste material that is cleaned or removed from the articles.

Additionally, the common practice is to gather articles to be cleaned and transport them to a common cleaning site where a vibratory abrasive cleaning apparatus is located. While it is desirable to have cleaning apparatus available for use in the field, currently, the known vibratory abrasive cleaning apparatus are too cumbersome to be easily transportable.

In attempt to overcome some of these prior art concerns, commonly assigned U.S. application Ser. No. 08/016,724, herein incorporated by reference, was filed Feb. 11, 1993 and discloses a vibrating abrasive cleaning apparatus. However, while the apparatus of the '724 application fulfills most of the prior art concerns, the disclosed apparatus is not as transportable as is desired.

Thus it is an object of the present invention to provide an easily transportable vibratory abrasive cleaning apparatus that addresses the environmental deficiencies of the prior art.

SUMMARY OF THE INVENTION

According to one embodiment of the present invention there is provided a mobile vibratory abrasive cleaning apparatus. The apparatus includes a flatbed having wheels upon which are mounted the other components of the apparatus which include a cleaning tank, means for vibrating the tank, a loop system for circulating the abrasive cleaner through the tank, control means and power means for running the apparatus.

The cleaning tank is mounted on the flatbed and is vibrated by a vibrating means to enhance the cleaning action.

A loop system for circulating abrasive cleaner through the tank includes spray means in the tank, an abrasive cleaner surge tank, filter system and drain system. The abrasive cleaner is pumped to the spray means from a cleaner surge tank, and after contacting the article to be cleaned, the abrasive cleaner drains from the cleaning tank and is pumped back to the cleaner surge tank. A filter may be provided in the surge tank and/or the drain system to remove solids from the system.

The system is powered by means such as a gas or diesel generator or in some instances where the flatbed is part of a truck unit, may be powered by the truck motor.

Finally, the system is generally controlled by a control system that may include computer/microprocessor units.

DETAILED DESCRIPTION OF THE INVENTION

Figure 1:
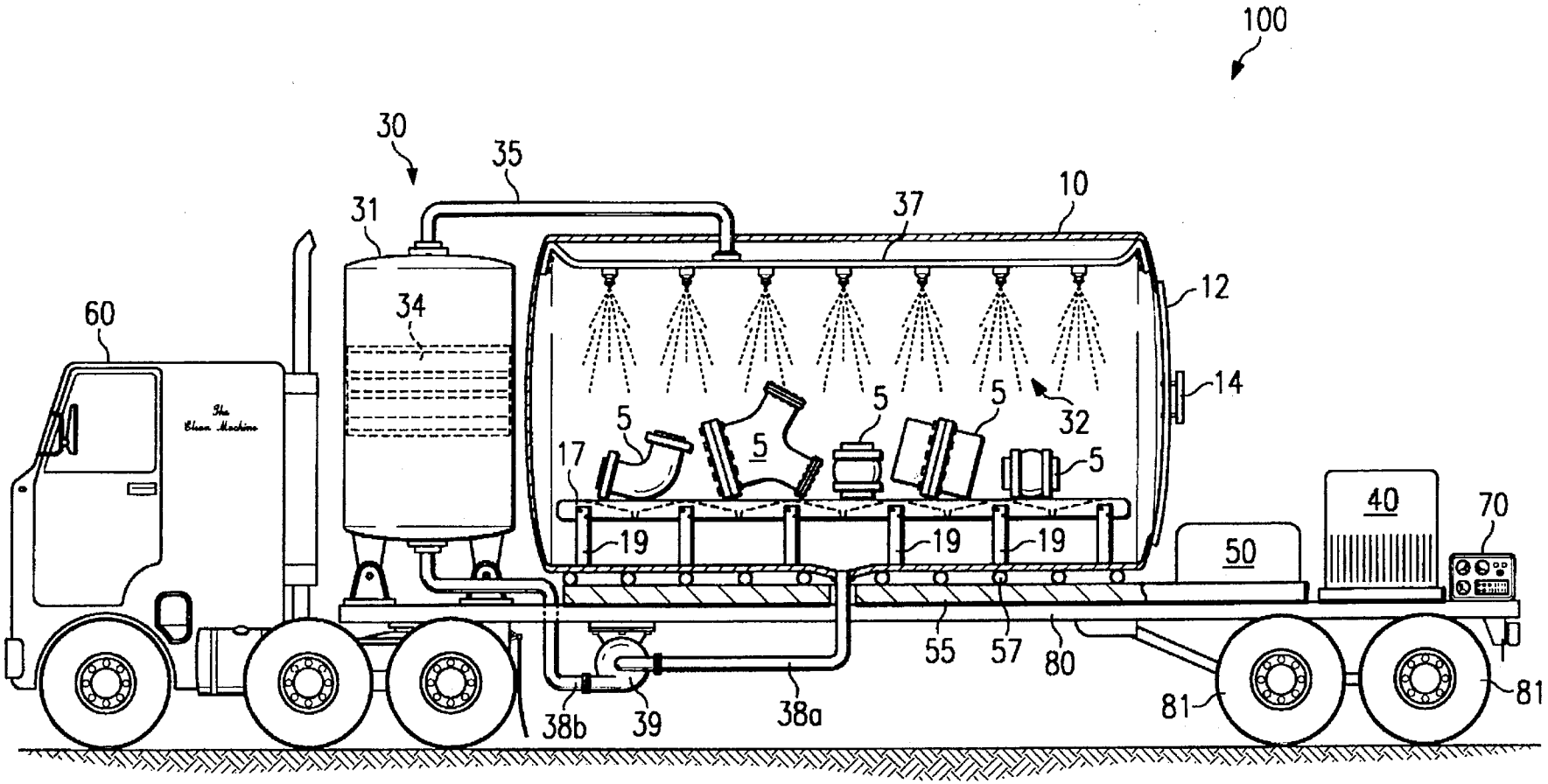
FIG. 1 is a schematic representation of one embodiment of the present invention showing the vibratory cleaning apparatus of the present invention.

Referring now to FIG. 1 there is shown a schematic representation of one embodiment of the present invention showing the vibratory cleaning apparatus 100 of the present invention including flatbed 80, cleaning tank 10, abrasive cleaner circulation loop 30, vibration means 50, power supply means 40 and controller means 70.

In the practice of the present invention, flatbed 80 may be a trailer independent of a truck or may comprise the flatbed of a truck. In the embodiment shown in FIG. 1, flatbed 80 with wheels 81 is a trailer that is hitched to truck 60 to render it easily mobile. Flatbed 80 will be sized to properly support the other components of vibrating abrasive cleaning apparatus 100.

Cleaning tank 10 utilized in the present invention generally comprises a rack 17 for holding articles 5 to be cleaned, and further comprises access door 12 operated by handle 14.

It is to be understood that the design of the tank is not of critical importance other than it must be suitable to withstand the rigors of the vibratory abrasive cleaning process and must be able to contain articles 5 to be cleaned.

Likewise, the positioning and design of access door 12 is also not critical other than it be functional in the cleaning process and sized to allow access of articles 5 to be cleaned.

Rack 17 is generally designed to allow for the flow of the liquid abrasive cleaner 32 and dislodged contaminant past articles 5, while supporting articles 5 above the bottom of tank 10. Rack 17 is supported in cleaning tank 10 by rack supports 19. Examples of suitable racks include the use of grating, screens and the like.

In the present invention, tank 10 is vibrated by vibrating means 50. Generally the vibration of tank 10 must be sufficient to enhance the cleaning of articles 5. Preferably, the vibration of tank 10 will result in the fluidization of part, if not substantially all, of the abrasive media in abrasive cleaner 32.

Vibrating means for imparting oscillatory vibration, linear vibration and other types of vibration to tank 10 are well known and any suitable vibration means may be utilized. For example, vibrating means 10 could comprise a motor driving an eccentric weight which rotates on an axis. Means are also known which can impart linear and/or elliptical motion. Additionally, the vibration may be sequenced by software and/or hardware.

In the embodiment shown in FIG. 1, tank 10 is mounted upon track 55 along which it is made to vibrate linearly on roller means 57 by vibratory means 50.

Abrasive cleaner circulation loop 30 of the present invention includes abrasive cleaner surge tank 31, piping 35, **38*a* and 38*b*, spray means 37, pump 39 and filter 34**.

Abrasive cleaner 32 may comprise additives well known to those in the art. Such additives include abrasive media such as stone chips, steel balls, naturally mined chips, wood media, ceramic media, plastic media, granite media, metal oxides and sand. Other additives include surfactants, antifoaming agents, finishing agents, cleaners, solvents and detergents.

Abrasive cleaner 32 is pumped from abrasive cleaner surge tank 31, through piping 35, then sprayed through spray means 37 where it contacts articles 5 in cleaning tank 10. After contacting articles 5, abrasive cleaner 32 flows past rack 17 to be pumped out of tank 10 and back to surge tank 31 via piping **38*a* and 38*b* and pump 39. Dislodged contaminants are removed via filter 34. In operation, articles 5 may be submerged in abrasive cleaner 32 or articles 5 may be above the level of abrasive clear 32** subjected to spraying action.

Filter 34 is generally sized to the anticipated size of contaminants to be removed from articles 5. A filter may also be provided prior to pump 39 to remove dislodged contaminants.

The power needs of the present invention will be provided by power supply means 40. Generally, power supply means 40 is any power supply means suitable to provide the necessary power requirements of the present invention. Suitable examples include gas and diesel generators. It is anticipated that solar power means and battery means may also be utilized, provided that they supply the necessary power required.

The present invention will be controlled by control means 70. Suitable examples for controls means 70 include microprocessor units or a computer.

In operation of the present invention, access door 12 is opened with articles 5 placed on rack 19 inside of cleaning tank 10. Next, vibratory abrasive cleaning is commenced by vibrating tank 10 with vibrating means 50, with abrasive cleaning fluid supplied by abrasive cleaning fluid loop 30. The operation is controlled via control means 70 with power supplied by power means 40.

The apparatus of the present invention may be utilized for descaling, deburring, grinding, fine finishing, burnishing and any other applications for which vibrating abrasive cleaning apparatus may be utilized.

Although the invention has been described with reference to specific embodiments, the present invention is not meant to be so limited. It is therefore understood that various modifications of the disclosed embodiments, as well as alternative embodiments of the present invention will become apparent to those of skill in the art upon reference to the description of the invention. It is therefore, contemplated that the claims will cover any such modifications or embodiments that fall within the true scope of the invention.

It is also understood that various equivalents may be substituted for any portion of the apparatus of the present invention and that these equivalents are to be within the scope of the claims of the invention.

I claim:

1. A mobile vibrating abrasive cleaning apparatus for cleaning an article with a cleaning fluid having abrasive media, the apparatus comprising:

(a) a frame having wheels;

(b) a cleaning container supported by the frame for holding the article during cleaning;

(c) a vibrator supported by the frame and operatively connected to the cleaning container to impart vibrations to the cleaning container;

(d) cleaning fluid entry port mounted inside the cleaning container and positioned to provide cleaning fluid to the article during cleaning;

(e) cleaning fluid drain operatively connected to the cleaning container for draining cleaning fluid from the cleaning container;

(f) cleaning fluid surge tank supported by the frame and in fluid communication with the cleaning fluid entry port and the cleaning fluid drain;

(g) fluid circulator for circulating the cleaning fluid and abrasive media, from the surge tank, through the entry port to the cleaning tank and through the drain to the surge tank;

(h) controller supported by the frame and operatively connected to the vibrator and the fluid circulator; and (i) power supply for supplying power to the vibrator and the fluid circulator.

2. The apparatus of claim 1 wherein the frame comprises a flatbed.

3. The apparatus of claim 1 wherein the frame comprises a truck.

4. The apparatus of claim 1 wherein the vibrator is suitable to provide at least one of linear or oscillatory vibrations.

5. The apparatus of claim 1 wherein the cleaning fluid entry port comprises sprayer.

6. The apparatus of claim 1 wherein the fluid circulator comprises a pump.

7. The apparatus of claim 1 wherein the controller comprises at least one of a microprocessor or computer.

8. The apparatus of claim 1 wherein the power means comprises at least one of a gas or diesel generator.

* * * * *